US007314139B2

(12) United States Patent
Senior et al.

(10) Patent No.: US 7,314,139 B2
(45) Date of Patent: Jan. 1, 2008

(54) PROCESS FOR SULPHIDE CONCENTRATION

(75) Inventors: Geoffrey Senior, Mount Claremont (AU); Scott Thomas, Mt. Hawthorn (AU); Brian Judd, Floreat (AU)

(73) Assignee: WMC Resources Limited, Victoria (AU)

( * ) Notice: Subject to any disclaimer, the term of this patent is extended or adjusted under 35 U.S.C. 154(b) by 422 days.

(21) Appl. No.: 10/474,758

(22) PCT Filed: Apr. 11, 2002

(86) PCT No.: PCT/AU02/00471

§ 371 (c)(1),
(2), (4) Date: Jun. 14, 2004

(87) PCT Pub. No.: WO02/083316

PCT Pub. Date: Oct. 24, 2002

(65) Prior Publication Data

US 2004/0217070 A1 Nov. 4, 2004

(30) Foreign Application Priority Data

Apr. 12, 2001 (AU) ..... PR4376

(51) Int. Cl.
*B03D 7/00* (2006.01)
*B03D 1/02* (2006.01)

(52) U.S. Cl. ..... 209/166; 209/167; 209/12.1; 209/17; 241/24.13

(58) Field of Classification Search ..... 209/164, 209/166, 167, 12.1, 17; 241/24.13
See application file for complete search history.

(56) References Cited

U.S. PATENT DOCUMENTS 4,283,017 A * 8/1981 Coale et al. ..... 241/20

(Continued)

FOREIGN PATENT DOCUMENTS

WO 93/04783 * 3/1993

* cited by examiner

*Primary Examiner*—Thomas M. Lithgow
(74) *Attorney, Agent, or Firm*—Miles & Stockbridge P.C.; Edward J. Kondracki

(57) ABSTRACT

The present invention relates to a gravity/flotation circuit where a mineral stream, such as a flotation rougher or cleaner concentrate, undergoes a two stage size separation wherein:

i) the screen of the first stage provides a coarse stream of particles greater than 110 microns and a fines stream of particles less than 110 microns; and ii) the fines stream of less than 110 microns is subjected to the second stage separation whereupon a cyclone provides an ultrafine/slimes stream of p80 less than about 25 microns and a middlings stream of p80 greater than around 25 microns.

The middlings stream is subjected to flotation to recover nickel sulphide which is sent to final concentrate, and reject or depress magnesia which undergoes gravity separation to concentrate the MgO. It has been discovered that a large proportion of the MgO minerals in the concentrate are contained in the 30 to 100 micron size fraction and that they are well liberated making physical separation possible. Furthermore, the nickel sulphide minerals and magnesia minerals have a significantly different specific gravity which can be exploited using gravity separation equipment to achieve magnesia rejection.

9 Claims, 2 Drawing Sheets

U.S. PATENT DOCUMENTS 4,425,227 A 1/1984 Smith
4,460,459 A * 7/1984 Shaw et al. ..... 209/9
4,946,597 A 8/1990 Sury
5,232,490 A 8/1993 Bender et al.
5,522,510 A 6/1996 Luttrell et al.
5,968,349 A 10/1999 Duyvesteyn et al.
6,146,444 A 11/2000 Kohr
6,286,686 B1 * 9/2001 Kelsey et al. ..... 209/44

PROCESS FOR SULPHIDE CONCENTRATION

FIELD OF THE INVENTION

The present invention relates generally to a method and an apparatus for separating a solid contaminant from a valuable mineral concentrate. The invention relates particularly, though not exclusively, to gravity separation of magnesia minerals from a nickel sulphide concentrate such as a serpentinitic hosted low grade nickel sulphide ore.

BACKGROUND OF THE INVENTION

The conventional development of low grade nickel sulphide serpentinitic ore bodies such as Mt Keith, Western Australia, have been limited by the requirement to produce a nickel concentrate product containing low levels of Magnesia (MgO) minerals. This constraint is usually referred to as the Iron to Magnesia ratio of the concentrate (Fe:MgO ratio). The MgO constraint is a result of a physical limitation of the downstream smelting process. The concentrate smelting process typically require Fe:MgO ratios of about 5.5, which corresponds to an MgO content of <5%. One means of increasing the Fe:MgO ratio is the addition of Fe to the concentrate however this is not an ideal solution as it dilutes the nickel content and reduces the smelter capacity. Hence the objective is to achieve an Fe:MgO ratio of 5.5 by rejecting MgO.

The conventional processing route for these types of ores involves crushing and grinding followed by concentration of the nickel through multiple stages of flotation. Conditions in the flotation process are optimised to recover Ni minerals and reject MgO minerals. This technology has been applied at Mt Keith and the concentrate Fe:MgO has averaged around 2.9 that corresponds to a MgO content of about 10%. Although not meeting the acceptable Fe:MgO specification, it has been possible for the smelter to accept this concentrate through blending the Mt Keith concentrate with concentrates from other locations. This blending has provided the smelter with the required 5.5 Fe:MgO ratio. However, the smelting requirement of the Fe:MgO of 5.5 limits the future amount of Mt Keith concentrate that can be smelted without blending with other concentrates.

SUMMARY OF THE INVENTION

According to one aspect of the present invention there is provided a method of separating a solid contaminant from a valuable mineral flotation concentrate, the method involving gravity separation and thus rejection of a majority of the contaminant from said flotation concentrate.

According to another aspect of the present invention there is provided an apparatus for separating a solid contaminant from a valuable mineral flotation concentrate, the apparatus including a gravity separator which is effective in separating and thus rejecting a majority of the contaminant from said flotation concentrate.

Preferably the gravity separator is a centrifugal separator designed so that centrifugal forces are imparted on the solid contaminant to effect its separation from the mineral flotation concentrate. More preferably the centrifugal separator is of a construction at least similar to a Kelsey jig.

According to a further aspect of the invention there is provided a method of processing a mineral stream including a solid contaminant, the method involving the steps of:

effecting a size separation of the mineral stream to produce a valuable mineral concentrate of a predetermined size range being predominant in the solid contaminant; and effecting gravity separation of the mineral concentrate to separate and thus reject a majority of the contaminant from the mineral concentrate.

According to yet another aspect of the invention there is provided an apparatus for processing a mineral stream including a solid contaminant, said apparatus comprising:

means for effecting a size separation of the mineral stream to produce a valuable mineral concentrate of a predetermined size range being predominant in the solid contaminant; and means for effecting gravity separation of the mineral concentrate to separate and thus reject a majority of the contaminant from the mineral concentrate.

Generally the valuable mineral concentrate is a valuable mineral flotation concentrate.

Preferably said size separation means includes a screen and the undersize material or fines from the screen at least in part provides the mineral concentrate being predominant in the solid contaminant. More preferably said separation means also includes a cyclone to which the screen undersize or fines is fed and an underflow of the cyclone or middlings at least in part provides the mineral concentrate being predominant in the solid contaminant.

Preferably the apparatus also includes flotation means being disposed between and arranged to operatively cooperate with the size separation means and the gravity separation means, said flotation means being designed to subject the valuable mineral concentrate or middlings to flotation to recover the valuable mineral and reject the solid contaminant which is fed to the gravity separation means. More preferably the apparatus further includes means for treating the valuable mineral concentrate or middlings with alkali and/or depressant to enhance flotation of the valuable mineral to a final concentrate and depress the solid contaminant to the gravity separation means.

Preferably the apparatus further includes another flotation means being designed to effect flotation of an overflow of the cyclone or ultrafines/slimes to recover the valuable mineral concentrate and reject the solid contaminant. More preferably the apparatus additionally includes means for treating the overflow or ultrafines/slimes with acid and/or activator to enhance flotation of the valuable mineral to a final concentrate and depress the solid contaminant to a concentrated contaminant or tails stream.

Preferably said gravity separation means includes a centrifugal separator. More preferably the centrifugal separator is of a construction at least similar to a Kelsey jig.

Preferably the size separation is performed to provide a middlings and an ultrafine/slimes stream, said separation being performed at a so called cut size in the range 20 to 50 micron with the range 25 to 45 micron being particularly preferred. More preferably the predetermined size range being predominant in the solid contaminant is the middlings stream being from between 30 to 110 microns.

Preferably the size separation is a multi-stage process. More preferably the multi-stage size separation includes a first stage to provide a coarse and a fines stream, and a second stage involving size separation of the fines stream to provide the ultrafine/slimes stream and the middlings stream of the predetermined size range.

Preferably the method also comprises the step of flotation of the middlings stream to recover the valuable mineral and reject the solid contaminant which undergoes the gravity separation to concentrate the solid contaminant. More preferably the middlings stream is treated with an alkali and/or depressant to enhance flotation of the valuable mineral to a final concentrate and depress the solid contaminant to thereafter undergo the gravity separation.

Preferably the method further comprises the step of flotation of the ultrafine/slimes stream to recover the valuable mineral and reject the solid contaminant. More preferably the ultrafine/slimes stream is treated with an acid and/or activator to enhance flotation of the valuable mineral to a final concentrate and depress the solid contaminant to a concentrated contaminant or tails stream.

Preferably the solid contaminant in the gravity separation means is rejected to a concentrated contaminant or tails stream which is subjected to flotation to recover residual valuable minerals from the mineral concentrate. More preferably the concentrated contaminant or tails stream is ground to liberate at least some of the residual valuable minerals prior to said flotation.

Preferably the gravity separation is conducted in at least two stages such as a rougher and a scavenger stage arranged in series. More preferably the gravity separation is performed on the middlings stream of the predetermined size range.

Preferably the mineral stream or mineral concentrate includes a valuable metal sulphide. More preferably the valuable metal sulphide is nickel sulphide hosted in a serpentinitic ore including magnesia minerals as the solid contaminants.

Typically the size separation for the nickel sulphide mineral is effected wherein particle sizes encompassed by the predetermined size range are less than about 120 microns. More typically the predetermined size range is from between about 30 to 110 microns.

It is understood that a large proportion of the magnesia minerals are contained in the size fraction 30 to 100 microns and are well liberated making physical separation possible. The nickel sulphide and the magnesia minerals have a significantly different specific gravity which lends the minerals to gravity separation to achieve magnesia rejection.

DETAILED DESCRIPTION OF THE PREFERRED EMBODIMENTS

In order to achieve a better understanding of the nature of the present invention a preferred embodiment of a method and an apparatus for separating a solid contaminant from a valuable mineral concentrate will now be explained in some detail, by way of example only, with reference to the attached flowsheets in which.

The flowsheets of these embodiments of the invention are based on pilot plant testing at Mt Keith, Western Australia, over a limited range of low grade nickel sulphide serpentinitic ore. The minerals stream introduced to the gravity circuit of these examples are a flotation concentrate having a high concentration of nickel with the resultant higher than allowable MgO content. The flotation concentrate is in this example either a rougher concentrate or a cleaner concentrate. It is to be understood for the purposes of this example that nickel is the valuable mineral and MgO or magnesia minerals are the solid contaminants.

Figure 1:
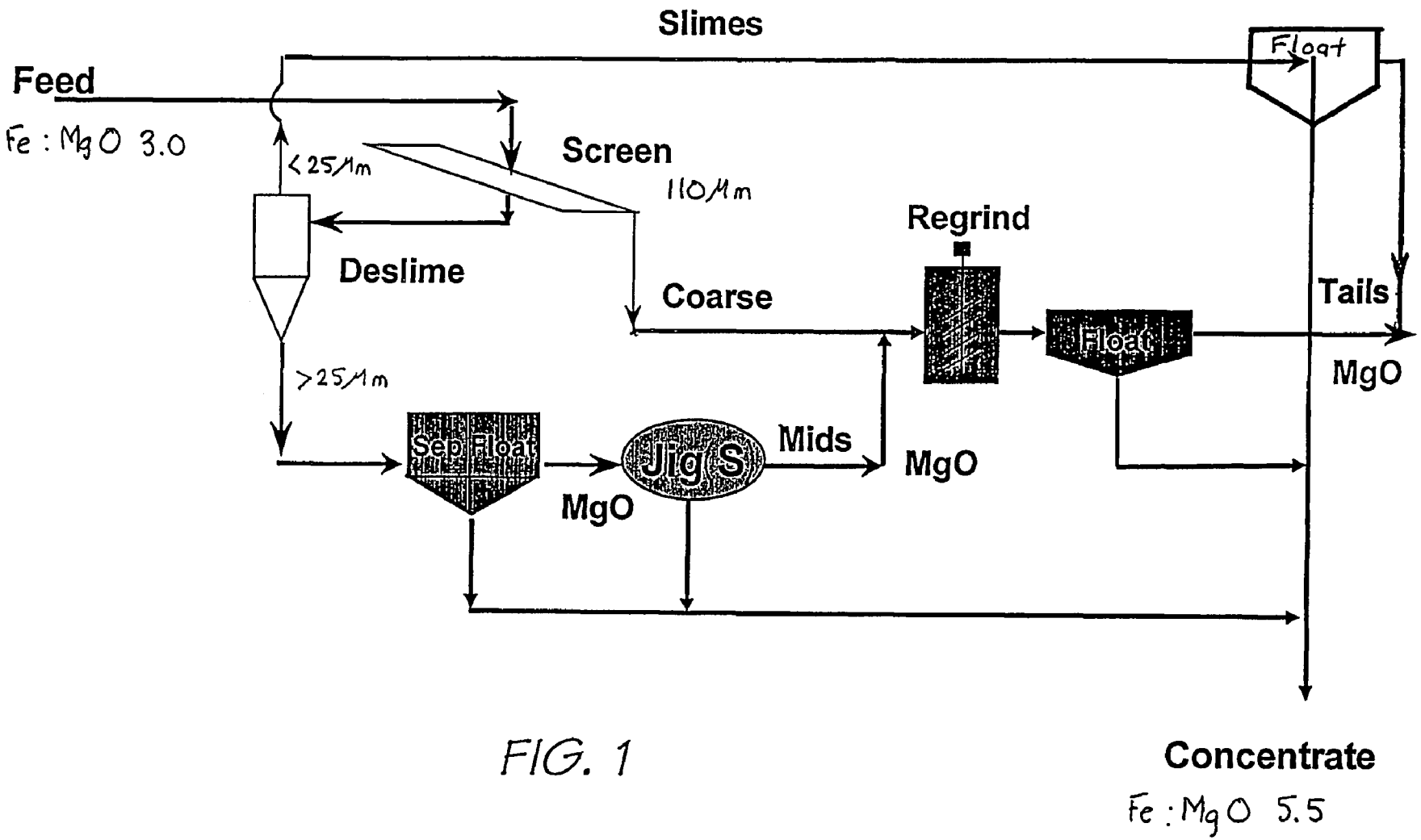
FIG. 1 shows one embodiment of a gravity/flotation circuit.

The mineral stream of FIG. 1 undergoes a two stage size separation wherein:

i) the screen of the first stage provides a coarse stream of particles greater than 110 microns and a fines stream of particles less than 110 microns; and ii) the fines stream of less than 110 microns is subjected to the second stage separation whereupon a cyclone provides an ultrafine/slimes stream of p80 less than about 25 microns and a middlings stream of p80 greater than around 25 microns.

The ultrafine/slimes stream is subjected to flotation at a low pH which selectively rejects MgO. During flotation of the ultrafine/slimes stream, acid and/or activator are added to enhance the flotation of nickel whilst depressing magnesia. The flotation concentrate is sent to final concentrate without further upgrading and the flotation tails is sent to a concentrated contaminant or tails stream. This flotation and upgrading of the ultrafine/slimes stream is typically performed at a pH of about 2 to 5.

The coarse stream of greater than 110 microns is reground in a tower mill in order to liberate the nickel sulphide from the MgO. The liberated coarse stream is then floated in order to recover residual nickel sulphide and reject MgO minerals to enhance the grade of the final concentrate. This also reduces the all important MgO concentration in the final concentrate.

The middlings stream of a p80 of less than about 25 microns is subjected to flotation to recover nickel sulphide which is sent to final concentrate, and reject or depress magnesia which undergoes gravity separation to concentrate the MgO. During flotation of the middlings stream, alkali and/or depressant are added to enhance the flotation of nickel sulphide whilst depressing MgO. In one example the pH of the middling stream is adjusted to a pH of between 9 to 11 using soda ash and the depressant guargum is added at rates of from 0 to 5000 g/tonne flotation feed.

It was discovered that a large proportion of the MgO minerals in the Mt Keith concentrate are contained in the 30 to 100 micron size fraction and that they are well liberated making physical separation possible. Furthermore, the nickel sulphide minerals and magnesium minerals have a significantly different specific gravity which can be exploited using gravity separation equipment to achieve magnesia rejection.

In this embodiment the concentrated MgO tails of the middlings flotation circuit is fed to a single or multiple stage gravity separation. The concentrate from the gravity separation device has relatively low concentrations of MgO and thus a very high Fe:MgO ratio. The tails from the gravity separation device reports together with the coarse stream to the regrind tower mill.

The preferred gravity separation device is a centrifugal separator designed so that both gravity and centrifugal forces are used to effect the required separation. The Kelsey jig is such an example of the centrifugal separator and is particularly effective in separating the MgO minerals from the nickel sulphide minerals of the attached flowsheets.

The jig tails of both embodiments are sent to the tower mill together with the coarse material from the screen. The tails are thus ground and floated together with the coarse material greater than 110 micron material with a view to rejecting more MgO in the flotation circuit to improve the grade of the final concentrate. The grind and float of the jig tails recovers additional nickel which may be otherwise lost and thus increases the recovery of the gravity circuit. That is, the combined gravity circuit flowsheet achieves high MgO rejection with minimal Nickel losses. In this embodiment this is effected by the combination of flotation, size separation, gravity separation and grinding to selectively reject MgO minerals while maintaining a high nickel recovery.

The application of a gravity separation device in this example poses a challenging task for traditional equipment due to the relatively fine particle size being treated. Traditional gravity separation devices generally have a lower limit of around 100 microns and thus are not particularly well suited to nickel sulphide serpentinitic ores such as that which exists at Mt Keith, Western Australia. In the gravity circuit described, the Kelsey jig which uses centrifugal forces rather than gravity alone is effective in separating particles of a finer particle size range. It is understood that the conventional use of gravity devices is to concentrate a valuable mineral, for example in the mineral sands and tin industry, as opposed to rejecting a contaminant such as its preferred application in the present invention. It is also understood that centrifugal separators, such as the Kelsey jig, have not been used in the sulphide metal industry.

The following table includes typical results from the pilot gravity/flotation circuit plant of FIG. 1.

| Stream | Ni Grade % | MgO Grade % | Fe Grade % |
|---|---|---|---|
| Feed | 20 | 8.6 | 26.1 |
| Screen O/S | 16.1 | 10.3 | 26.1 |
| Cyclone O/F | 18.1 | 9.5 | 23.5 |
| Cyclone U/F | 21 | 8.3 | 26.8 |
| Float + Jig Con | 25.1 | 3.0 | 29.8 |
| Jig Tail | 8.6 | 24.2 | 17.7 |
| Refloat Tail | 4.1 | 29.7 | 19.4 |
| Combined Con | 22.9 | 5 | 27.2 |

This process increases the concentrate Fe:MgO ratio from about 3 to about 5.5. Thus, the process of this example has the potential to reject MgO from the Mt Keith concentrate achieving an Fe:MgO of 5.5 thereby making the final concentrate smeltable in its own right.

Figure 2:
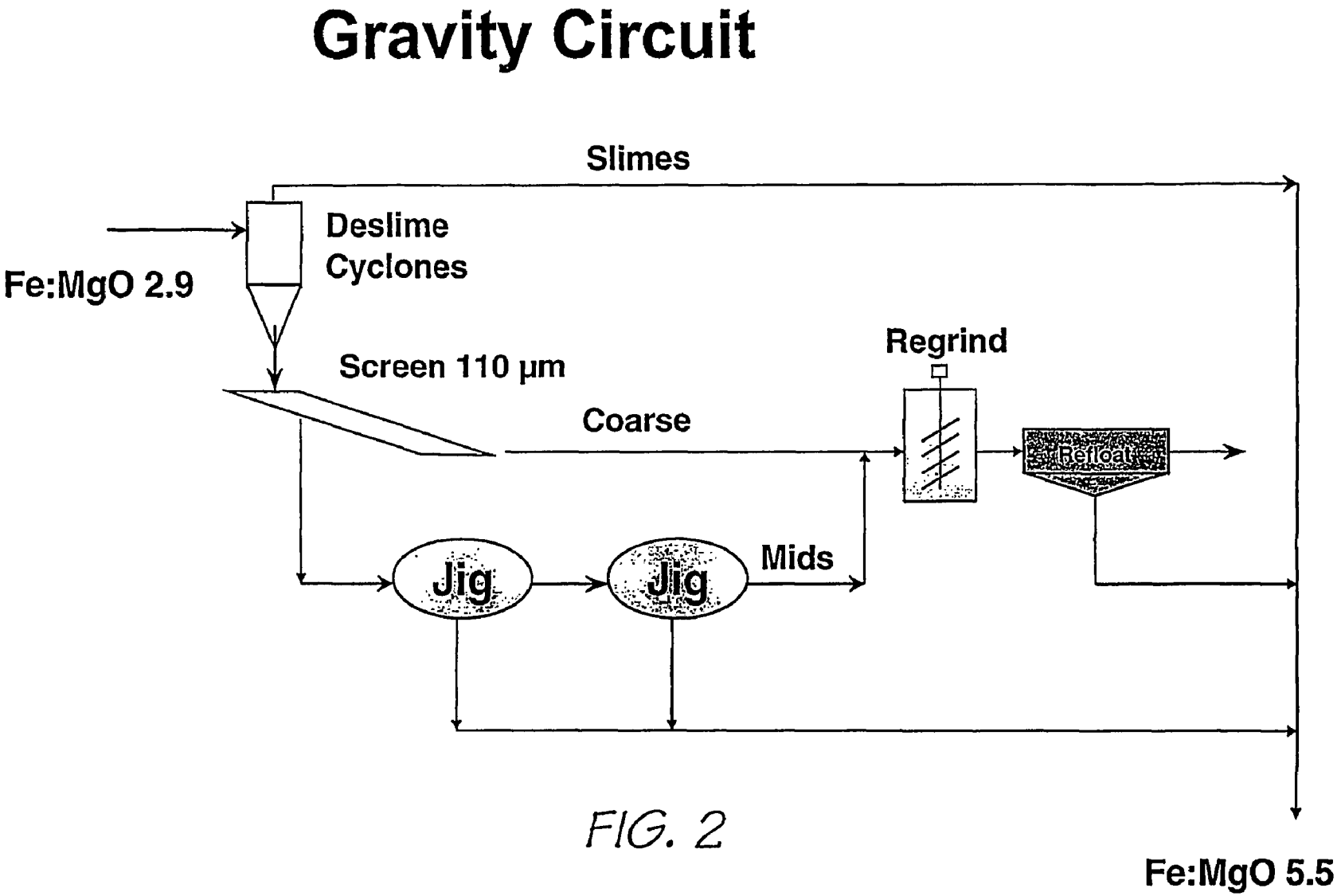
FIG. 2 illustrates another embodiment of a gravity/flotation circuit.

The mineral stream of the alternative embodiment of FIG. 2 undergoes a two stage size separation wherein:

i) the de-slime cyclone of the first stage provides an ultra-fine or slimes stream of p80 less than about 25 microns and coarse stream of p80 greater than around 25 microns ii) the coarse stream is subjected to the second stage separation whereupon a screen provides an ultra-coarse stream of particles greater than 110 microns and a fines/middlings or valuable mineral concentrate of between 30 to 110 microns.

The ultra-fine or slimes stream of the pilot plant is sent directly to final concentrate without upgrading. However, it is the applicant's intention to subject this stream to flotation at low pH which selectively rejects MgO. The coarse stream is reground in a tower mill in order to liberate the nickel sulphide from the MgO. The liberated coarse stream is then floated in order to recover residual nickel sulphide and reject MgO minerals to enhance the grade of the final concentrate. This also reduces the all important MgO concentration in the final concentrate.

In this embodiment, the nickel sulphide concentrate stream of the 30 to 110 microns size fraction is fed to a two stage rougher and scavenger gravity separation. The rougher concentrate reports to the final concentrate and the rougher tails reports to the scavenger separation stage to recover additional nickel minerals. The rougher concentrate has relatively low concentrations of MgO and thus a very high Fe:MgO ratio. The scavenger concentrate similarly reports to the final concentrate with particularly high Fe:MgO ratios.

As shown in the flowsheet of FIG. 2, the process in pilot plant scale testing increases the concentrate Fe:MgO from 2.9 to 5.5 with a loss of less than 3% nickel. More recent results have indicated a loss as low as 1.5% nickel. This compares with a greater than 10% recovery loss when using conventional flotation alone to increase the Fe:MgO from 2.9 to 3.8. The target of 5.5 has not previously been achievable using conventional flotation. Thus, the process of this embodiment has the potential to reject MgO from the Mt Keith concentrate achieving an Fe:MgO of 5.5 thereby making the final concentrate smeltable in its own right. It is expected that the process has potential to be applied to other ore bodies removing what otherwise has been a significant impediment to their development.

The following table includes typical results from the pilot gravity circuit plant of FIG. 2 at Mt Keith.

| | Circuit Feed | Slimes Stream | Gravity Con | Gravity Tail | Cal' Final Con |
|---|---|---|---|---|---|
| Mass | 100 | 8 | 69 | 22 | 87.1 |
| Ni Rec | 100 | 8 | 85 | 7 | 97.2 |
| MgO Rec | 100 | 9 | 29 | 62 | 50.4 |
| Ni Grade | 22 | 22 | 25 | 6 | 24.6 |
| Fe Grade | 28 | 24 | 31 | 12 | 30.2 |
| MgO Grade | 9 | 10 | 4 | 30 | 5.4 |
| Fe:MgO | 2.9 | 2.4 | 7.1 | 0.4 | 5.5 |

Now that several preferred embodiments of the invention have been described in some detail it will be apparent to those skilled in the art that the method and apparatus for separating a solid contaminant from a valuable mineral concentrate have at least the following advantages:

i) the ability to treat a particular mineral concentrate without the need to blend to increase the Fe:MgO for smelting;

ii) the potential to expand the process to other ore bodies with relatively high levels of contaminant, such as MgO minerals; and iii) the ability to reject relatively high levels of the solid contaminant whilst minimising loss of the valuable mineral.

Those skilled in the art will appreciate that the invention described herein is susceptible to variations and modifications other than those specifically described. For example, the gravity separator is not limited to a centrifugal separator but rather will be dictated by the particular mineral size and specific gravity of the solid contaminant to be rejected. The process need not be limited to a size separation but rather may involve gravity separation alone of an already liberated mineral concentrate/solid contaminant.

All such variations and modifications are to be considered within the scope of the present invention the nature of which is to be determined from the foregoing description.

It is to be understood that, if any reference to prior art is made herein, such reference does not constitute an admission that the prior art forms a part of the common general knowledge in the art, in Australia or any other country.

The invention claimed is:

1. A method of processing a mineral stream containing valuable nickel sulphide and a solid contaminant in the form of magnesia (MgO) that includes the steps of:

(a) separating a feed stream in a first stage on a screen into a coarse stream of particles greater than 110 microns and a fines stream of particles less than 110 microns;

(b) separating the fines stream in a cyclone in a second stage and producing an ultra fines/slimes stream of P80 less than 25 microns and a middlings stream of P80 greater than 25 microns;

(c) subjecting the middlings stream to flotation and recovering nickel sulphide which is sent to final concentrate and rejecting or depressing MgO in a tails stream; and (d) treating the rejected/depressed MgO-containing tail stream by gravity separation and concentrating the MgO.

2. A method as defined in claim 1 wherein the gravity separation in step (d) is conducted in at least two stages such as a rougher and a scavenger stage arranged in series.

3. A method as defined in claim 1 wherein the coarse stream from step (a) is ground and then floated to reject more of the MgO.

4. A method as defined in claim 1 wherein the middlings stream is treated with an alkali and/or depressant to enhance flotation of the nickel sulphide in step (c) to the final concentrate and depress the MgO to thereafter undergo the gravity separation.

5. A method as defined in claim 1 wherein the ultrafine/slimes stream is subjected to flotation in a further step to reject any of the MgO to upgrade the concentration of nickel sulphide.

6. A method as defined in claim 5 wherein said ultrafine/slimes stream is treated with an acid and/or activator to enhance flotation of the nickel sulphide to a final concentrate and depress the MgO to a concentrated contaminant or tails stream.

7. A method as defined in claim 1 wherein the MgO is rejected to a concentrated contaminant or tails stream which is subjected to flotation in a further step to recover residual valuable minerals from the mineral concentrate.

8. A method as defined in claim 7 wherein the concentrated contaminant or tails stream is ground to liberate at least some of the residual nickel sulphide prior to said flotation.

9. A method as defined in claim 1 wherein the fines stream from step (a) is from between about 30 to 110 microns.

* * * * *